US009314911B2

(12) United States Patent
Jacobson et al.

(10) Patent No.: US 9,314,911 B2
(45) Date of Patent: Apr. 19, 2016

(54) UNIVERSAL QUICK-CHANGE HOOK FOR PNEUMATIC TOOLS

(71) Applicant: Situation Innovation Corporation, Mashpee, MA (US)

(72) Inventors: Scott D. Jacobson, Mashpee, MA (US); Gary S. Ford, Plymouth, MA (US); Paul H. Kirk, East Falmouth, MA (US)

(73) Assignee: Situation Innovation Corporation, Mashpee, MA (US)

( * ) Notice: Subject to any disclaimer, the term of this patent is extended or adjusted under 35 U.S.C. 154(b) by 199 days.

(21) Appl. No.: 13/960,275

(22) Filed: Aug. 6, 2013

(65) Prior Publication Data

US 2014/0048668 A1 Feb. 20, 2014

Related U.S. Application Data

(60) Provisional application No. 61/742,627, filed on Aug. 15, 2012.

(51) Int. Cl.
*A45F 5/00* (2006.01)
*B25C 7/00* (2006.01)

(52) U.S. Cl.
CPC .... *B25C 7/00* (2013.01); *A45F 5/00* (2013.01)

(58) Field of Classification Search
USPC ..... 248/690, 692, 227.1, 301, 304, 305; 224/268, 269, 904, 666; 227/156, 154; 81/487, 488
See application file for complete search history.

(56) References Cited

U.S. PATENT DOCUMENTS

| | | | | | |
|---|---|---|---|---|---|
| 1,856,847 | A * | 5/1932 | Gates | 248/231.81 |
| 3,827,677 | A * | 8/1974 | Meyerhoefer et al. | 366/282 |
| 4,406,064 | A * | 9/1983 | Goss | 30/298.4 |
| 4,787,145 | A * | 11/1988 | Klicker et al. | 30/275.4 |
| 4,895,336 | A * | 1/1990 | Lieberman | 248/690 |
| 6,010,103 | A | 1/2000 | Ashworth | |
| 7,611,037 | B1 * | 11/2009 | Bazzano | 227/154 |
| 2007/0084615 | A1 | 4/2007 | Lai | |
| 2007/0295885 | A1 * | 12/2007 | Vidal | 248/682 |
| 2008/0173785 | A1 * | 7/2008 | Hagler et al. | 248/690 |
| 2009/0107301 | A1 * | 4/2009 | Lambert | 81/121.1 |

OTHER PUBLICATIONS

Gunook Sky Hook, retrieved from the Internet Aug. 1, 2013, http://www.gunook.com/skyhook.html, 2 pages.

* cited by examiner

*Primary Examiner* — Alfred J Wujciak
(74) *Attorney, Agent, or Firm* — Hamilton, Brook, Smith & Reynolds, P.C.

(57) ABSTRACT

Pneumatic tools are staple elements of constructions sites. Pneumatic tools are often hand-carried to specific locations and balanced on an available surface or between the knees of a worker while the worker uses two hands for related activities. A universal quick-change hook according to an embodiment of the invention can be coupled between fittings of a pneumatic tool and pneumatic hose without obstructing airflow though the fittings and provides a hook stop to protect fittings attached to the universal quick-change hook, preventing accidental activation of a connection release. The universal quick-change hook is configured to support the weight of an attached tool from a wide variety of different support means, such as a ladder, lumber stock, nail, or utility belt. The universal quick-change hook provides a worker with a convenient way to secure a hook to pneumatic tools in rapid fashion to be more efficient and competitive on a jobsite.

16 Claims, 9 Drawing Sheets

UNIVERSAL QUICK-CHANGE HOOK FOR PNEUMATIC TOOLS

RELATED APPLICATION

This application claims the benefit of U.S. Provisional Application No. 61/742,627, filed on Aug. 15, 2012, the entire teachings of which are incorporated herein by reference.

BACKGROUND OF THE INVENTION

Pneumatic-actuated tools, sometimes referred to as "air" tools, are a type of power tool common at construction sites. Pneumatic tools are a category of power tools actuated by compressed air, usually supplied by a gas or electric compressor, delivered to the pneumatic tool by way of an air hose. Examples of pneumatic tools include nail guns, impact wrenches, and drills. Pneumatic fittings on both the air hose and the pneumatic tool enable connecting and disconnecting on demand. Typically, pneumatic tools are equipped with a male fitting component that mates with a female fitting on the end of the air hose. These pneumatic fittings can be attached and disconnected without the use of tools.

Pneumatic tools, because of their remote air supply, are easily carried by a worker to various locations around a job site, often switching to a new supply of compressed air at each location. It is also common for the worker with a pneumatic tool, such as a nail gun, to climb ladders or traverse joists while carrying the pneumatic tool in order to reach a location where the pneumatic tool is needed. For example, during the construction of a roof with asphalt tiles, a worker may climb one or more ladders to reach the roof and subsequently traverse various sections of the roof while placing asphalt tiles at the various sections and affixing the asphalt tiles with nails driven by a pneumatic nail gun.

A worker usually keeps a pneumatic tool in one or both hands while working on a jobsite, but must place the tool on a surface or otherwise suspend it from the worker's belt or a nearby fixture to use both hands freely or to change to a second pneumatic tool. Using a second pneumatic tool may also require detaching the pneumatic hose from the first tool and reattaching the pneumatic hose to the second tool. Workers commonly use pneumatic tools while at the top of a ladder to insert roofing nails on the roof of a building to secure roofing tiles or in other typically dangerous environments. In such dangerous situations, the worker is both safer and more efficient when able to easily stow the pneumatic tool and use both hands where necessary.

SUMMARY OF THE INVENTION

Embodiments of the present invention provide a universal quick-change hook designed to accept two (input and output) pneumatic fittings. With an attached pneumatic fitting, the universal quick-change hook is configured to attach to an existing pneumatic fitting on a pneumatic tool. When attached, the universal quick-change hook allows a worker to easily stow or support the pneumatic tool from a wide variety of shapes and objects with the universal quick-change hook while also protecting the pneumatic fitting from accidental disconnection. The universal quick-change hook also includes a hook stop to protect a quick-release mechanism of an attached pneumatic fitting from being accidently struck by an object when the universal quick-change hook is placed on that object to support the attached pneumatic device while also providing attachment and support functions, such as to fixtures or belts, for the pneumatic tool and pneumatic hose. The hook stop of the universal quick-change hook reduces that risk that a pneumatic tool will fall from an elevated support and cause an injury and/or damage to the tool.

An example embodiment of the present invention is a universal quick-change hook, comprising a main body having a first end and a second end, a fitting interface region at the first end of the main body, a fitting extension region adjacent to the fitting interface region in a direction of the second end of the main body, and a fitting bend located at an intersection of the fitting interface region and the fitting extension region. The fitting bend defines an inside surface of the main body and an outside surface of the main body. The universal quick-change hook also has a hook region, adjacent to the fitting extension region, and a hook stop, projecting from the inside surface of the main body, at an intersection of the fitting extension region, and the hook region.

Other embodiments may include a pneumatic fitting coupled to the main body in the fitting interface region in an orientation enabling a direction of airflow though the pneumatic fitting perpendicular to the main body at the fitting interface region, the pneumatic fitting having and inlet and an outlet with flow path therebetween.

In some embodiments, the outlet of the pneumatic fitting is a push-type coupler, and the hook stop is arranged to protect the push-type coupler. A pneumatic hose may be connected to the inlet of the pneumatic fitting or the outlet of the pneumatic fitting. In one embodiment, the hook stop extends to a location between the push-type coupler and a location of a hook-side end of a tool, employing a standard corresponding fitting, coupled to the push-type coupler. The tool may be pneumatic-actuated tool.

In some embodiments, the hook stop projects from the inside surface of the main body between −20 and 20 degrees off perpendicular from a planar surface of the fitting interface region.

In one embodiment, the hook stop has a proximal end at the main body and a distal end distal from the main body, and wherein the hook stop includes a barb at the distal end. In some embodiments, the hook stop is between 0.5 and 2 inches in length.

In another embodiment, the angle of the fitting bend is between 30 and 80 degrees with respect to a planar surface of the fitting interface region.

In some embodiments, the main body of the universal quick-change hook may include a taper at the second end of the main body. In one embodiment, the hook region includes a taper bend, the taper bend defined by an angle greater than 180 degrees with respect to the inside surface of the main body.

In another embodiment, the main body of the universal quick-change hook includes a hook bend, the hook bend located at an intersection of the fitting extension region and the hook region, the hook bend defined by an angle less than 180 degrees with respect to the inside surface of the main body.

In some embodiments, the fitting extension region includes a nail hanging hole defined by the main body and extending through the main body. The nail hanging hole may have a subhole smaller in diameter than a head of a nail from which the universal quick-change hook is to be suspended. The hook region may be configured to support the main body against a structure to which a nail is attached when the nail hanging hole of the main body is placed around the nail. The main body at the hook region may define a wrench hole, and the wrench hole may be a hex opening.

Another embodiment of the present invention is an anchor assembly with an anchor pneumatic fitting. The anchor pneumatic fitting has a mating port gender opposite from a mating port gender of a pneumatic fitting to be coupled thereto. The anchor assembly may be configured to be coupled to a utility belt.

In yet another embodiment, a utility belt comprises an attached anchor, where the attached anchor provides a fitting for attaching a device or hose having a corresponding mating fitting. The anchor may be a pneumatic fitting for attaching a pneumatic tool or a universal quick-change hook with the mating fitting.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Traditionally, pneumatic tools do not include any shape or structure designed to support the pneumatic tool from a utility belt or common features found in environments where pneumatic tools are typically used. To a limited degree, a pneumatic tool can be suspended from an attached air hose, or the handle can be balanced on a wall, but such positions are potentially dangerous and require careful balance to ensure equipment does not fall and strike a person working below. After-market hooks provide additional ways for pneumatic tools to be supported, and typical after-market hooks are connected between the tool and the male pneumatic fitting used for connecting the pneumatic tool to an air supply. However, changing after-market hooks of the typical design is an impractically long process in the typical, fast-paced, construction environment. For example, today's after-market hooks require a tool's pneumatic fitting to be unscrewed from a threaded connecting to the tool and, in doing so, require a reapplication of a sealing tape, e.g., Teflon tape, to maintain an air-tight connection.

Figure 1:
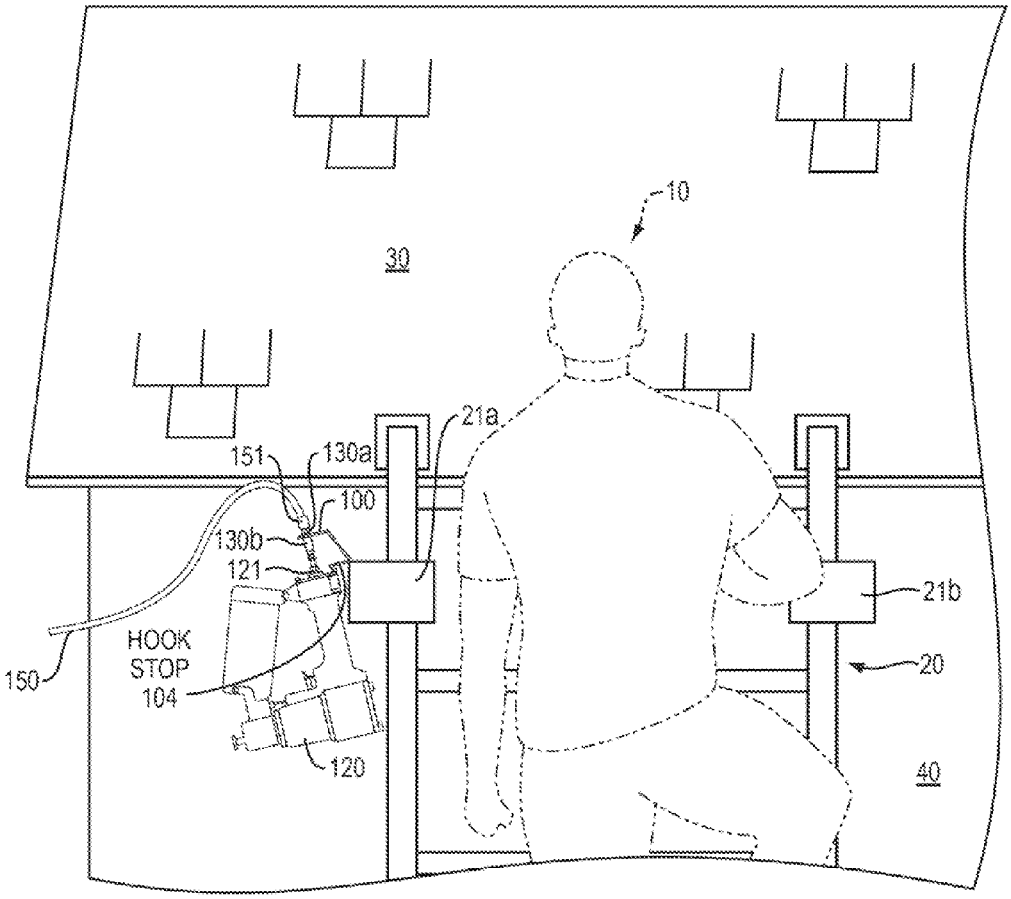
FIG. 1 is a diagram showing an embodiment of the present invention in an example environment in which a pneumatic tool, such as a nail gun, is employed.

FIG. 1 is a diagram showing an embodiment of the present intention in an example environment, such as a roofing worksite environment. In the environment, a worker 10 is positioned on an extension ladder 20 with rail guides 21*a-b*. The ladder is positioned to reach a roof 30 of a house 40 and the worker 10 is using two hands to support himself against the ladder 20. A nail gun 120 is suspended from a rail guide 21*a* within reach of the worker 10 by way of a universal quick-change hook 100, which has features of an embodiment of the present invention. The universal quick-change hook 100 is attached to the nail gun's 120 pneumatic fitting 121 by way of a corresponding pneumatic fitting 130*b* attached to the universal quick-change hook 100.

During use of the nail gun 120, an air hose 150 delivers compressed air to the nail gun 120, allowing the worker 10 to drive nails (not shown) into roofing tiles (not shown), for example. The universal quick-change hook 100 is attached to a pneumatic fitting 151 on the end of the air hose 150 by way of a corresponding pneumatic fitting 130*a* attached to the universal quick-change hook 100. The corresponding pneumatic fitting 130*b* attached to the nail gun 120 is positioned opposite the corresponding pneumatic fitting 130*a* attached to the air hose 150, such that both fittings 130*a* and 130*b* are connected to each other through the universal quick-change hook 100 and provide a flow path (not shown) for compressed air to power the nail gun 120.

The universal quick-change hook includes a hook stop 104 to prevent the rail guide 21*a* from reaching the connected pneumatic fittings 130*b* and 121. The hook stop 104 enables the universal quick-change hook 100 to support the nail gun 120 from the rail guide 21*a* without the rail guide's 21*a* affecting a quick-release mechanism on the pneumatic fitting 130*b* or otherwise influencing the connection between the universal quick-change hook 100 and the nail gun 120. Additionally, the hook stop 104 positions the universal quick-change hook 100 and attached nail gun 120 at a given position with respect to the rail guide 21*a*. In this example, the universal quick-change hook 100 provides the worker 10 the ability to use a common feature found in environments where pneumatic tools are typically used, i.e., a rail guide 21*a* of an extension ladder 20, to support a nail gun 120 whenever the worker needs to have both hands free. In other example environments, a worker 10 can hang a nail gun 120 with an attached universal quick-change hook 100 from a loop on a utility belt (shown in FIG. 2), a beam or joist, or an edge of a surface.

The universal quick-change hook 100 can be disconnected from the pneumatic tool 120 and pneumatic hose 150 and used with different pneumatic tools and hoses or enabling the universal quick-change hook 100 to stay with the same pneumatic tool or hose. The flexibility of association is used for most jobsites and for the individual worker.

Figure 2:
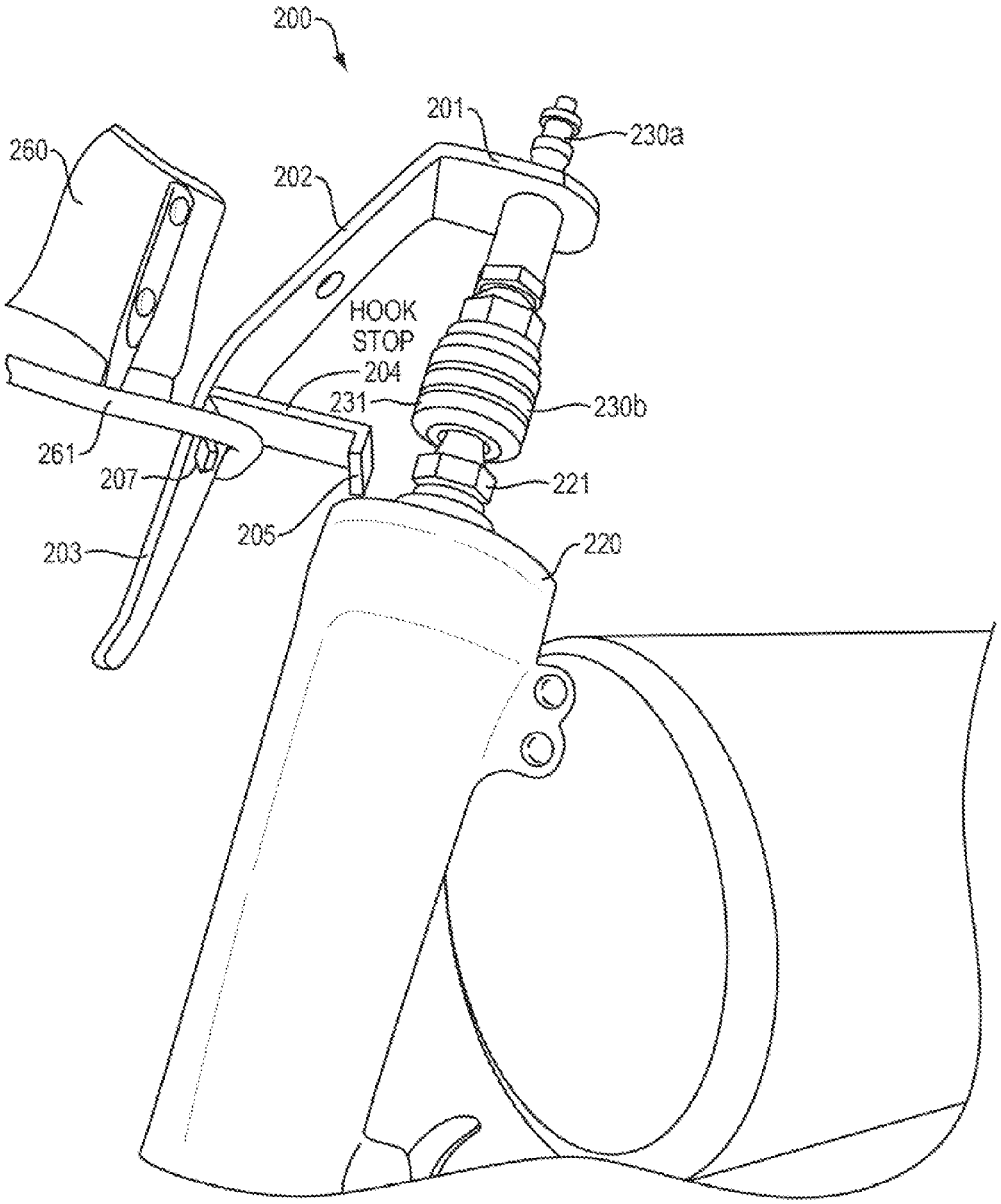
FIG. 2 is a diagram illustrating of an embodiment of the present invention supporting a pneumatic tool on a tool belt.

FIG. 2 is a diagram illustrating of an embodiment of the present invention supporting a pneumatic tool 204 on a tool (or utility) belt 260. A nail gun 220 is suspended from a metal loop 261 on the utility belt 260 with a universal quick-change hook 200. Utility belts 260 are commonly used to carry tools and often have metal loops 211 to support hammers or other tools too large to fit in pouches attached to the belt 260. To attach to pneumatic tools, the universal quick-change hook 200 has a fitting interface region 201 with a male pneumatic fitting 230*a* and a female pneumatic fitting 230*b*. The female pneumatic fitting 230*b* has a push-type quick release collar. The pneumatic fittings 230*a-b* are connected through the fitting interface region 201 via a common flow path axially through the pneumatic fittings 230*a-b* to allow compressed to be supplied to the pneumatic tool 220 with the universal quick-change hook 200 attached.

The nail gun 220 is powered by compressed gas provided through a male pneumatic fitting 221. Using this existing male attachment fitting 221, the universal quick-change hook 200 is attached to the nail gun 220 with the corresponding female pneumatic fitting 230*b*. The universal quick-change hook 200 supports the nail gun 220 on the metal loop 211 with a hook region 203 and a hook stop 204.

The hook stop 204 prevents the metal loop 261 of the utility belt 260 from reaching the female pneumatic fitting 230*b*. This prevents accidental release of the female pneumatic fitting 230*b* from the nail gun's 220 pneumatic fitting 221 from the metal loop's 211 striking the release collar 231 of the female pneumatic fitting 230*b*. To ensure that the metal loop 261 cannot reach the female pneumatic fitting 230*b* and to keep the universal quick-change hook 200 on the metal loop 261, a barb 205 is provided on the end of the hook stop 204 to prevent the metal loop 261 from sliding off the edge of the hook stop 204. The hook region 203 is separated from the fitting interface region 201 by a fitting extension region 202. The fitting extension region 202 positions the hook region 203 away from the pneumatic fittings 203*a-b* and any attached pneumatic tool 220.

The hook region 203 in combination with the hook stop 204 allows the universal quick-change hook 200 to be suspended from a wide variety of support members. For example, the universal quick-change hook 200 with attached nail gun 220 can be supported by a beam of wood, such as the short side of a typical 2×4 beam, or the hook region 203 can rest against a flat board while the nail gun 220 leans over the edge. Generally, any support member with a width less than the distance between the nail gun 220 and the hook region 203 can support the universal quick-change hook 200. If the support member is of a width less than the distance of the hook region 203 to the nail gun 220, the weight of the attached nail gun 220 is entirely supported by the universal quick-change hook 200.

In this example embodiment, the universal quick-change hook 200 enables a worker (not shown) wearing a typical utility belt 260 with a metal loop 261 to easily support a nail gun 220 attached to the universal quick-change hook 200 from the metal loop 261 of the worker's utility belt 260. In operation, the hook region 203 of the universal quick-change hook 200 is placed inside the metal loop 261, and the weight of the universal quick-change hook 200 and attached nail gun 220 rests against the hook region 203, the hook stop 204, or both.

Figure 3:
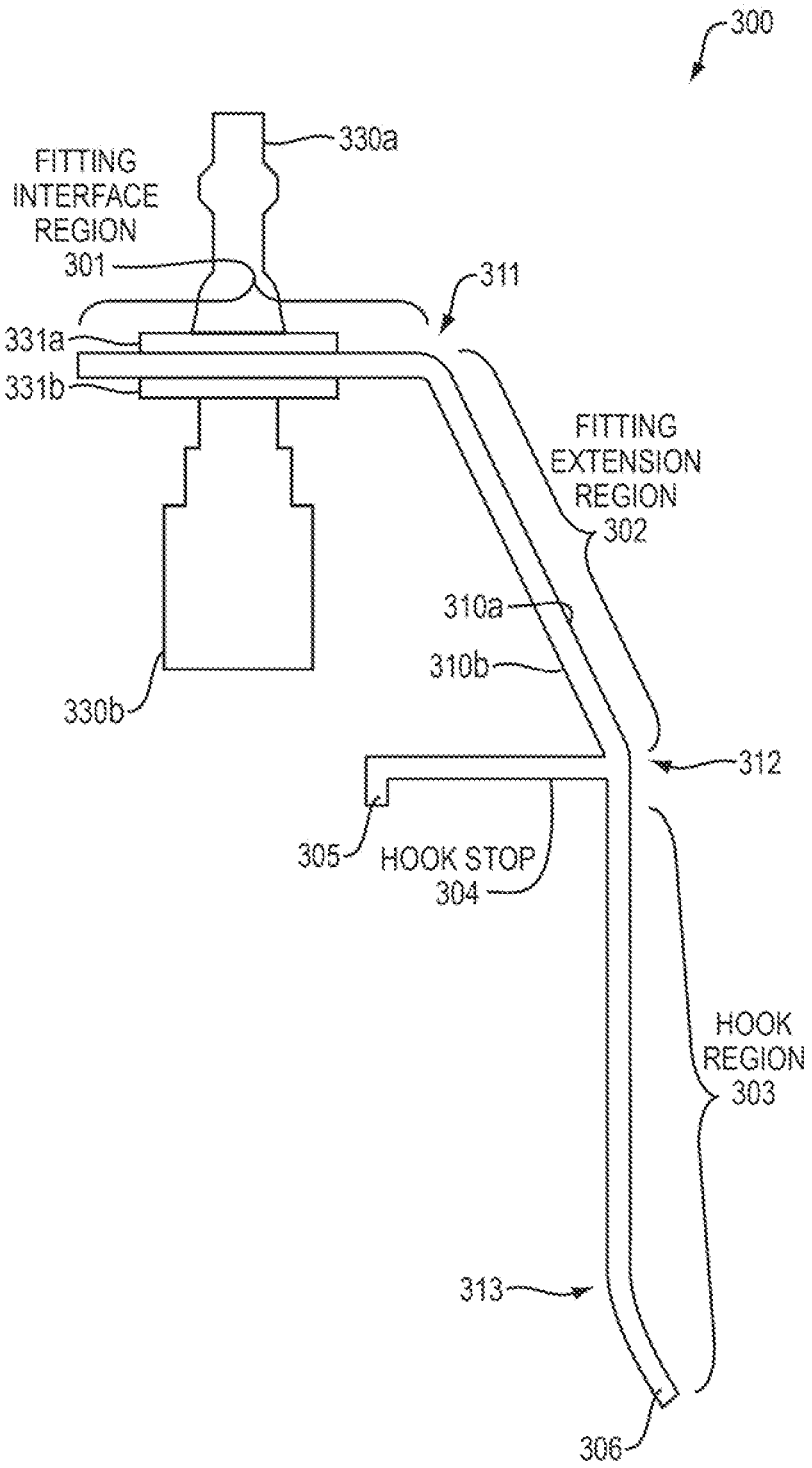
FIG. 3 is a profile view of an embodiment of the present invention.

FIG. 3 is a profile view of an embodiment of the present invention. A universal quick-change hook 300, with an outside surface 310*a* and an inside surface 310*b*, is shown with pneumatic fittings 330*a-b* connected to a fitting interface region 301. Washers 331*a-b* allow the pneumatic fittings 330*a-b* with threaded fasteners to be screwed together against the fitting interface region 301. The universal quick-change hook 300 has a fitting bend 311 at the intersection of the fitting interface region 301 and the fitting extension region 302. A hook bend 312 is provided at the interface of the fitting extension region 302 and the hook region 303. The hook region 303 terminates with a tapered region 306 and a tapered bend 313. The tapered bend 313 is defined by an angle greater than 180 degrees with respect to the inside surface 310*b* of the universal quick-change hook 300. In this illustration, the hook stop 304 protrudes from a point on the universal quick-change hook 300 near the hook bend 312.

For a typical sized embodiment, the hook stop 304 can range between 0.5 and 2 inches in length, depending on the angle of the fitting bend 311 and length of the fitting extension region 302. The dimensions can be modified for different sized embodiments or different angles of the hook stop 305. The hook stop 304 is positioned to terminate between the female pneumatic fitting 330*b* and an attached pneumatic tool (not shown). The hook stop 304 has a barb 305 at the free end to prevent a support means (not shown) from sliding between the hook stop 304 and the attached pneumatic tool. The universal quick-change hook 300 can be made out of steel, plastic, or any other material sufficiently strong to support the weight of an attached pneumatic tool.

Figure 4A:
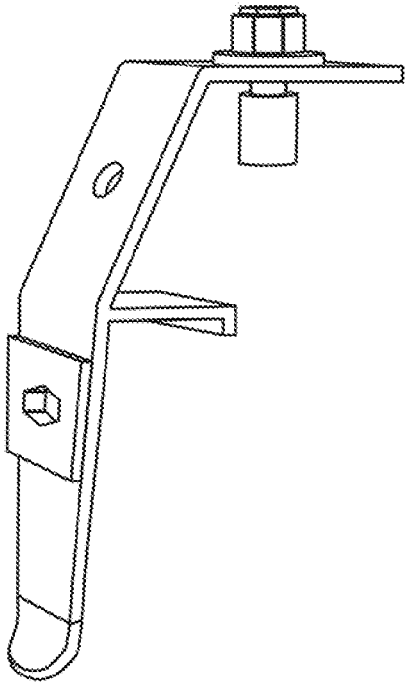
FIGS. 4A-C are angular views of an embodiment of the present invention.
Figure 4B:
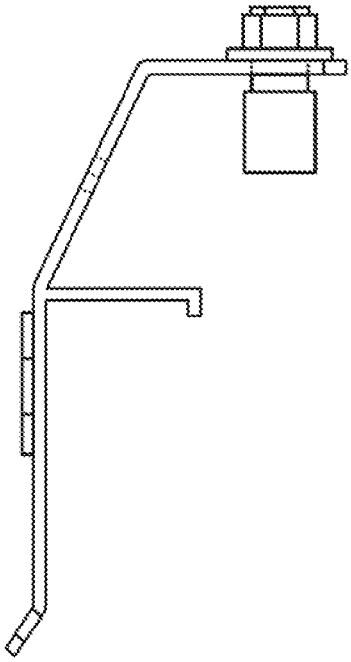
Figure 4C:
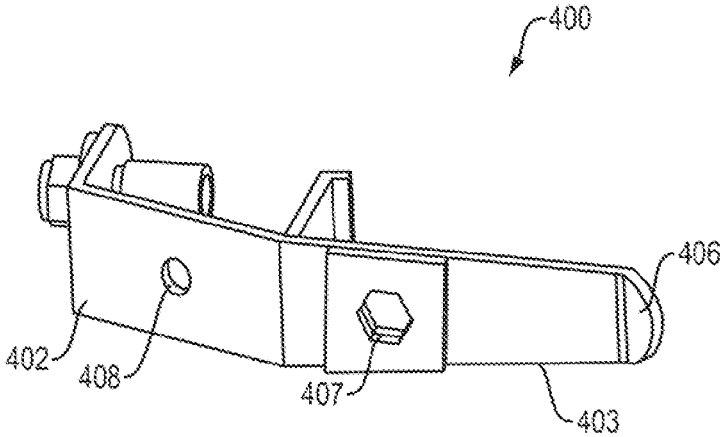

FIGS. 4A-C are angular views of an embodiment of the present invention. A universal quick-change hook 400 is shown with a nail hole 407 in the fitting extension region 402 and a wrench tool 407 in the hook region 403. In other embodiments, the nail hole 408 can be any through-hole in the universal quick-change hook 400 that allows the universal quick-change hook 400 to be suspended against a surface having a protruding nail (not shown), as shown in FIG. 5.

The nail hole 408 may have a smaller subhole (not shown) having a diameter smaller than a nail of the nail head from which the universal quick-change hook 400 is to be suspended to prevent the universal quick-change hook 400 from accidentally sliding off the nail. The wrench tool 407 is shown in FIG. 4 as a protrusion from the hook region 403 having a hex socket indentation; in other embodiments, the wrench tool 407 is out of the hook region 403 as an opening having a hex socket profile or other wrench profile.

Figure 5:
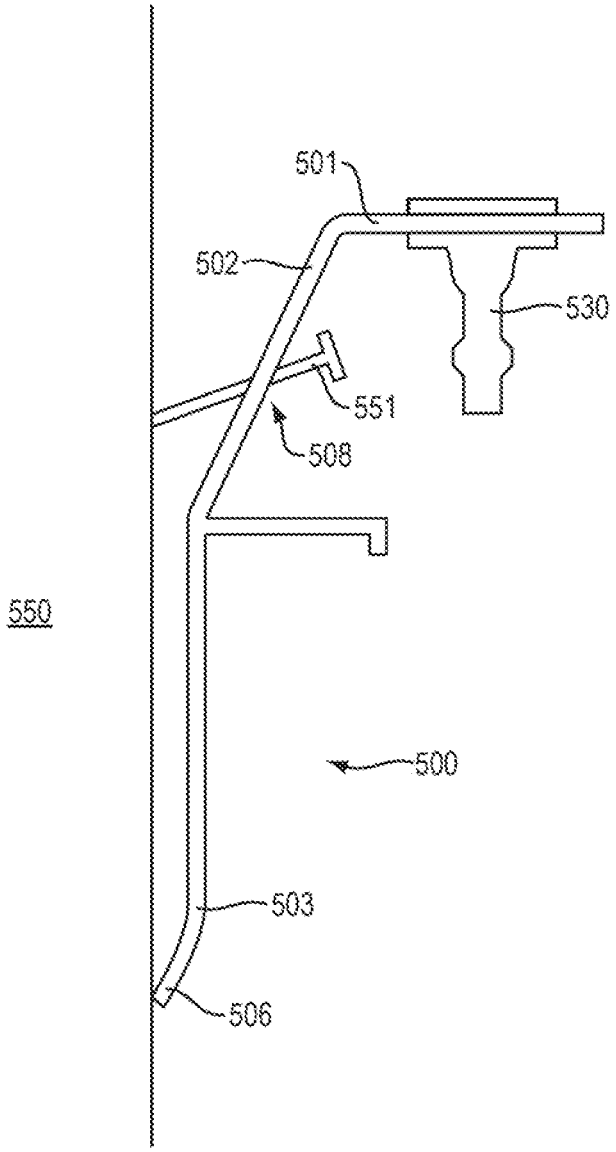
FIG. 5 is diagram illustrating of an embodiment of the present invention supported by a nail protruding from a surface.

FIG. 5 is diagram illustrating of an embodiment of the present invention attached to a surface 550 having a protruding nail 551. The universal quick-change hook 500 has a nail hole 508 through the fitting extension region 502. The universal quick-change hook 500 is suspended from the nail 551 by way of the nail hole 508. The weight of the universal quick-change hook 500 and any device coupled to a fitting 530 attached to a fitting interface region 501 of the universal quick-change hook 500 is supported by the nail 551 through the nail hole 508 and the hook region 503 where the universal quick-change hook 500 makes contact with the surface 550. FIG. 5 shows the hook region 503 of the universal quick-change hook 500 having a tapered region 506 making contact with the surface 550.

As described above in reference to FIGS. 4A-C, the nail hole 508 may have a subhole to allow the nail 551 to slide upward relative to the nail hole 508 after the head of the nail 551 has passed through the nail hole 508.

Figure 6:
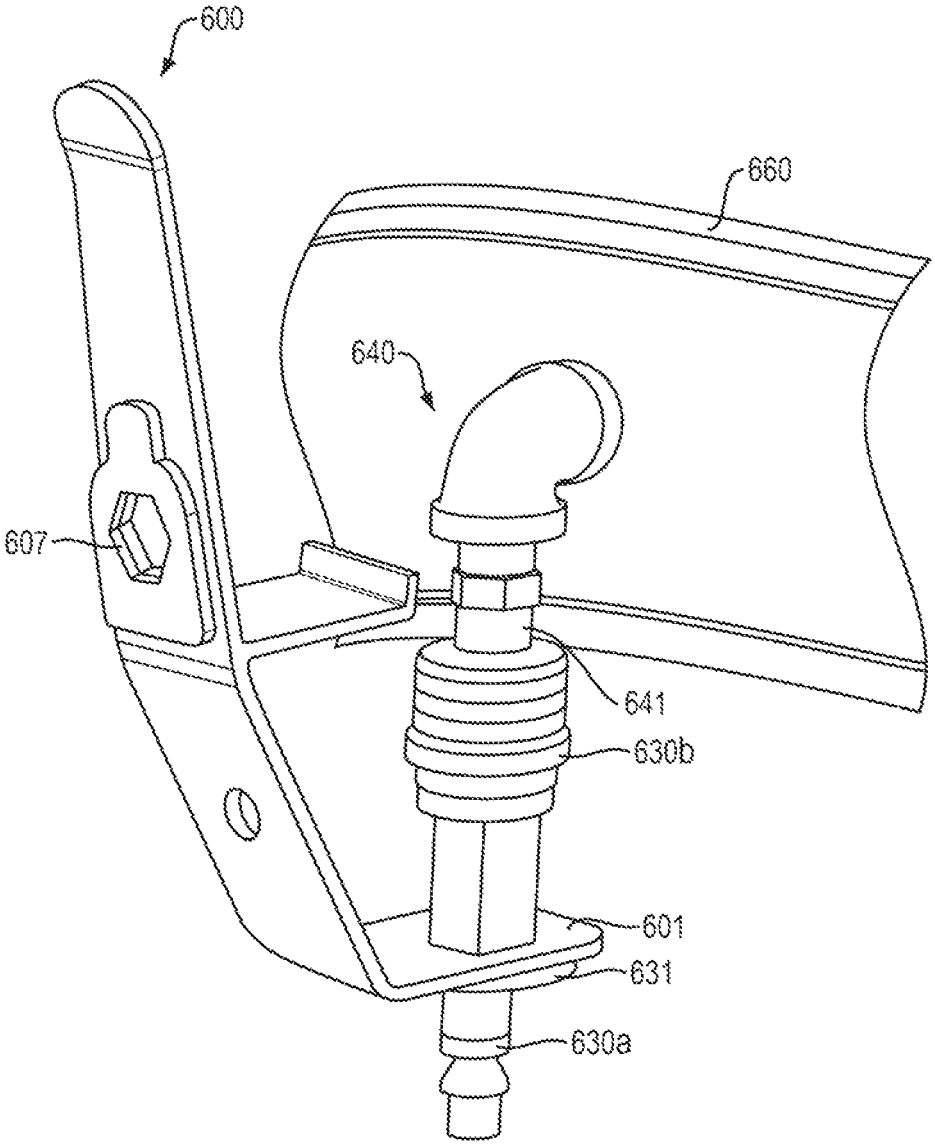
FIG. 6 is a mechanical schematic diagram illustrating an embodiment of the present invention attached to a utility belt using an anchor fitting.

FIG. 6 is a mechanical schematic diagram illustrating an embodiment of the present invention attached to a utility belt using a pneumatic fitting anchor. A pneumatic fitting anchor 640 is provided on a utility belt 660. The pneumatic fitting anchor 640 connects a fitting 641 to the utility belt 660. A universal quick-change hook 600 is shown having a male pneumatic fitting 630*a* and a female push-type pneumatic fitting 630*b*, where the male fitting 630*a* is attached to the fitting interface region 601 of the universal quick-change hook 600 with a single washer 631. The female push-type pneumatic fitting 630*b* is connected to the male pneumatic fitting 641 of the pneumatic fitting anchor 640 on the utility belt 660. In this configuration, the universal quick-change hook 600 is a support device enabling a utility belt 660 to support objects (not shown) hung from the universal quick-change hook 600. FIG. 6 also shows the universal quick-change hook 600 having an integrated socket wrench 607.

It should be understood that tools or hoses having mating fittings corresponding to the fitting 641 of the utility belt 660 can be connected directly to the utility belt 660 without need for the universal quick-change hook 600.

Figure 7A:
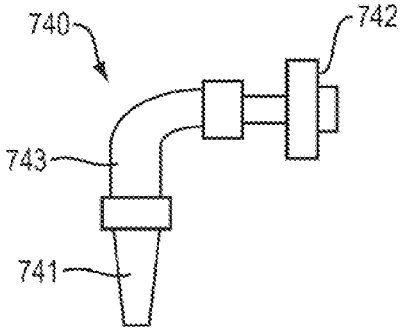
FIGS. 7A and 7B are illustrations of the utility belt and pneumatic fitting anchor used with embodiment of the present invention.
Figure 7B:
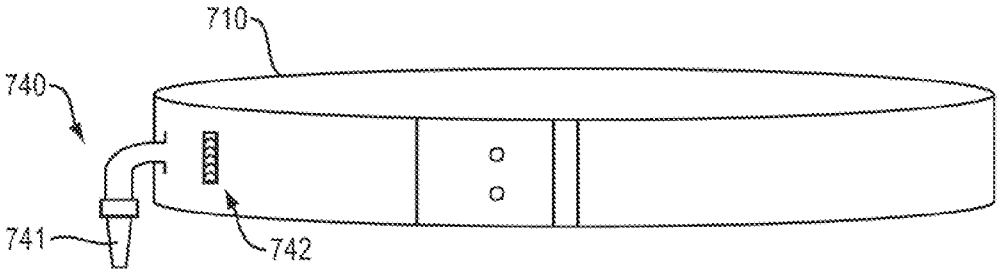

FIGS. 7A and 7B are illustrations of the utility belt and pneumatic fitting anchor used with embodiments of the present invention. FIG. 7A shows a pneumatic fitting anchor 740 having a fitting 741 connected to a belt anchor 742 by a support member 743. FIG. 7B shows the pneumatic fitting anchor 740 of FIG. 7A connected to a utility belt 710. The belt anchor 742 secures the pneumatic fitting anchor 740 to the material of the utility belt 710 and fitting 741.

Figure 8A:
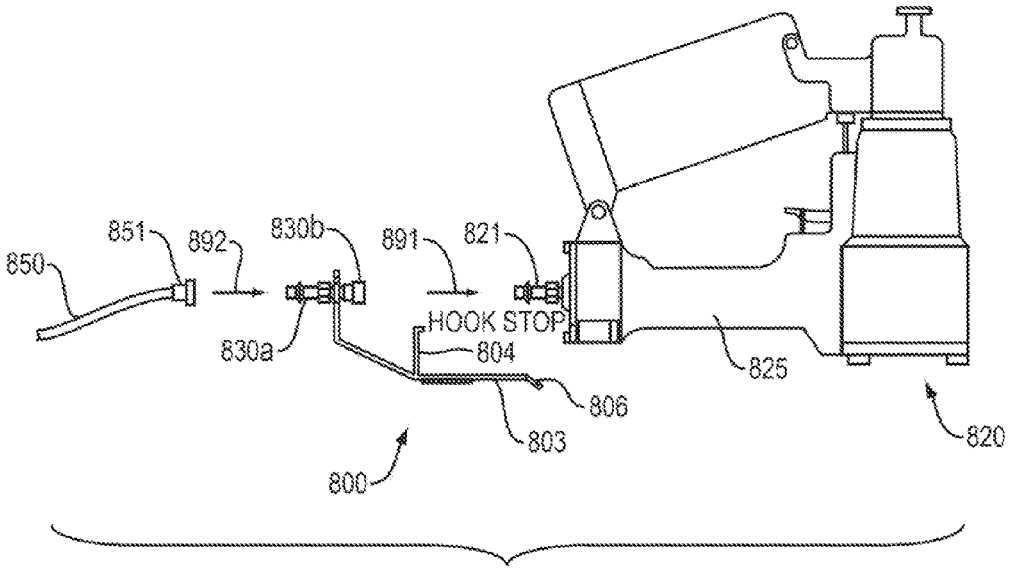
FIG. 8A is a diagram illustrating the operation of an embodiment of the present invention being connected to a pneumatic hose and the pneumatic tool of FIG. 3.

FIG. 8A is a diagram illustrating the operation of an embodiment of the present invention being connected to a pneumatic hose and a pneumatic tool. In operation of one embodiment of the present invention, a universal quick-change hook 800 is connected to both a pneumatic tool 820 and an air hose 850. The universal quick-change hook 800 has attached pneumatic fittings 830*a-b* for connecting to both the pneumatic tool 820 and the air hose 850. Typically, pneumatic tools have a male pneumatic fitting 821 protruding from an end of a main handle 825. This male pneumatic fitting 821 is coupled to a corresponding female pneumatic fitting 830*b* on the universal quick-change hook 800 by pushing the fittings together along a concentric path 891. When coupled, the hook region 803 of the universal quick-change hook 800 is positioned adjacent and offset from the handle 825 of the pneumatic tool 820. A hook stop 804 provides a third surface between the hook region 804 and the handle 825 and prevents an object (not shown) placed against the hook region 804 or between the hook region 804 and the handle 825, such as a belt loop (as shown in FIG. 2), from reaching the female pneumatic fitting 830*b* and causing an accidental disconnect of a quick release mechanism on the pneumatic fitting 830*b*.

Additionally, the male pneumatic fitting 830*a* of the hook universal quick-change hook 800 is connected with the female pneumatic fitting 830*b* such that the universal quick-change hook 800 does not restrict airflow between them, allowing for compressed air to be delivered from the air hose 850 to the pneumatic tool 820 when both are connected to the corresponding fittings 830*a-b* of the universal quick-change hook 800. To connect to the male pneumatic fitting 830*a* of the universal quick-change hook 800, the air hose is fitted with a female pneumatic fitting 851 at one end. The female pneumatic fitting 851 is coupled to the corresponding male pneumatic fitting 830*a* on the universal quick-change hook 800 by pressing both fittings together along a concentric path 892. Once the air hose 850 is connected to the universal quick-change hook and the universal quick-change hook 800 is connected to the pneumatic tool 820, the pneumatic tool 820 and the air hose 850 can be individually disconnected from the universal quick-change hook 800 by disconnecting only pneumatic fitting 851 or 830*b*, respectively.

Figure 8B:
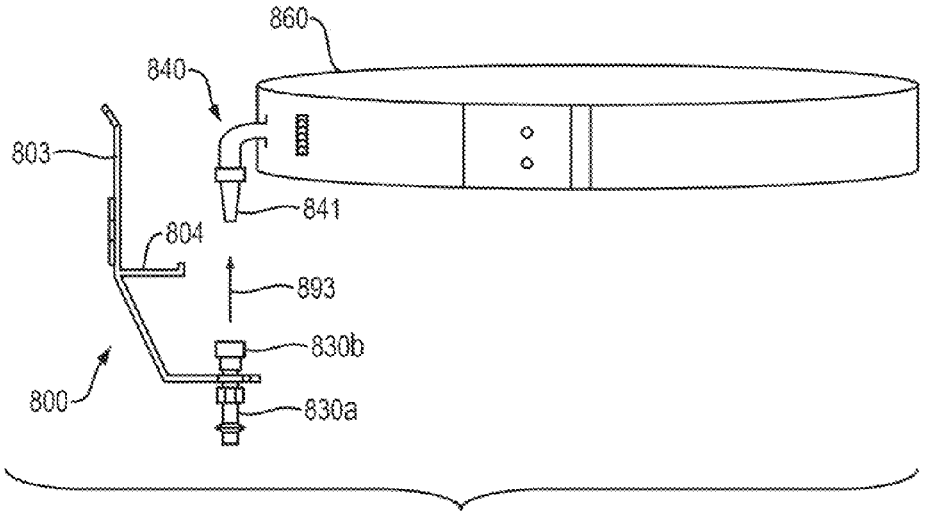
FIG. 8B is a diagram illustrating the operation of an embodiment of the present invention being connected to the pneumatic fitting anchor and utility belt of FIG. 6.

FIG. 8B is a diagram illustrating the operation of an embodiment of the present invention being connected to the pneumatic fitting anchor and utility belt of FIG. 6. In operation of one embodiment of the present invention, the universal quick-change hook 800 is connected to a pneumatic anchor 840 on a utility belt 860 having a male pneumatic fitting 841. The universal quick-change hook 800 has an attached female pneumatic fitting 830*b* for connecting the corresponding male pneumatic fitting 841 of the pneumatic anchor 840. The female pneumatic fitting 830*b* of the universal quick-change hook 800 is coupled to the corresponding male pneumatic fitting 841 on the pneumatic anchor 840 by pressing both fittings together along a concentric path 893. Once connected, the universal quick-change hook 800 is stowed on the utility belt 860, and the hook region 803 and hook stop 804 may be used together as a versatile support means for objects able to fit between the hook region 803 and the pneumatic anchor 840.

Figure 9A:
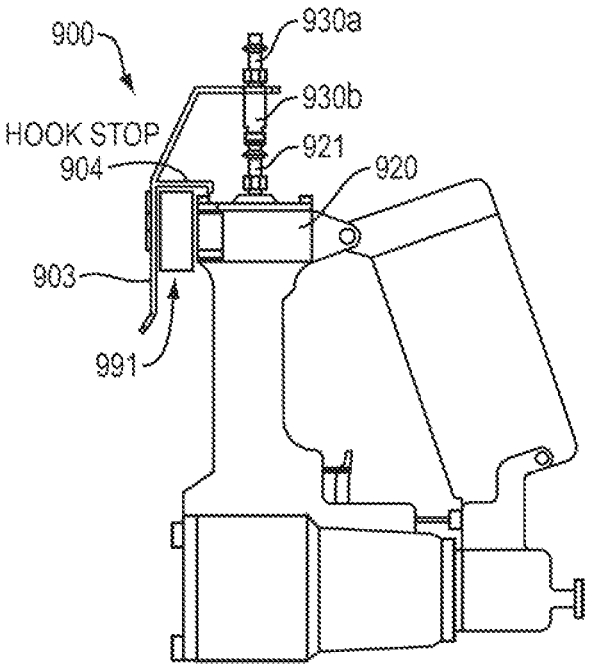
FIGS. 9A and B are diagrams illustrating an embodiment of the present invention supporting a pneumatic tool from various objects.
Figure 9B:
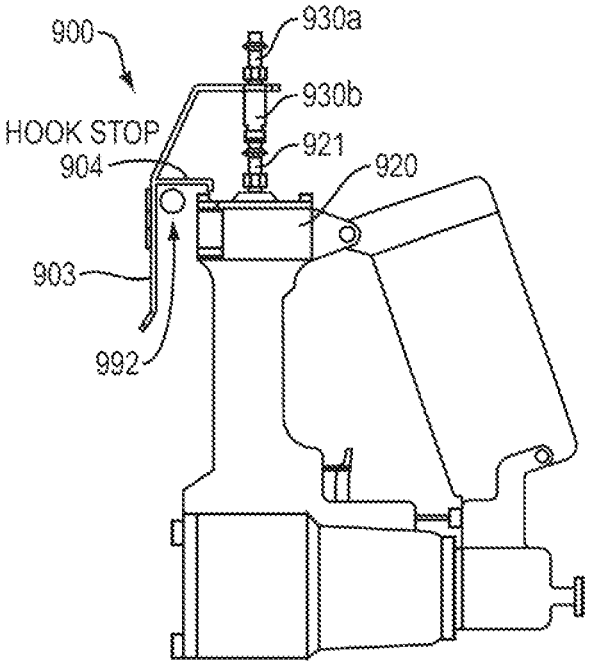

FIGS. 9A and B are diagrams illustrating an embodiment of the present invention supporting a pneumatic tool from a wooden beam (FIG. 9A) and a metal rod (FIG. 9B). FIG. 9A shows a nail gun 920 with a pneumatic fitting 921 connected to of a corresponding female pneumatic fitting 930*b* on a universal quick-change hook 900. The universal quick-change hook 900 has a male pneumatic fitting 930*a* connected to the female pneumatic fitting 930*b* that is supporting the nail gun 920. The nail gun 920 can be delivered compressed air though fittings 930*a-b*. The universal quick-change hook 900 is supporting the nail gun 920 against a wooden beam 991, which could be a common 2×4. The hook stop 904 of the universal quick-change hook 900 is resting against the wooden beam 991 and the universal quick-change hook is further held in place by the hook region 903 of the universal quick-change hook 900. The hook region 903 prevents the universal quick-change hook 900 from sliding off the wooden beam 991.

FIG. 9B shows a nail gun 920 with a pneumatic fitting 921 attached to a universal quick-change hook 900 by way of a corresponding female pneumatic fitting 930*b*. The universal quick-change hook 900 has a male pneumatic fitting 930*a* connected to the female pneumatic fitting 930*b* that is supporting the nail gun 920 such that the nail gun 920 can be delivered compressed air though fittings 930*a-b*. The universal quick-change hook 900 is supporting nail gun 920 against a metal rod 992. The hook stop 904 of the universal quick-change hook 900 and hook region 903 of the universal quick-change hook 900 are resting against the metal rod 992.

While this invention has been particularly shown and described with references to example embodiments thereof, it will be understood by those skilled in the art that various changes in form and details may be made therein without departing from the scope of the invention encompassed by the appended claims.

What is claimed is:

1. A universal quick-change hook for hand-held pneumatic tools, comprising:

a main body having a first end and a second end;

a fitting interface region at the first end of said main body, wherein the fitting interface region extends in a horizontal direction;

a fitting extension region between the first the second ends of said main body and adjacent to the fitting interface region, wherein the fitting extension region extends downwardly at an angle below the fitting interface region;

a fitting bend located at an intersection of said fitting interface region and said fitting extension region, said fitting bend defining an inside surface of said main body and an outside surface of said main body;

a pneumatic fitting coupled to the main body in the fitting interface region in an orientation enabling a direction of airflow though the pneumatic fitting perpendicular to the main body at the fitting interface region, said pneumatic fitting having an inlet and an outlet with a flow path therebetween;

a hook region at the second end of said main body and adjacent to the fitting extension region, wherein the hook region extends downwardly from the fitting extension region at an angle below the horizontal direction;

a hook stop projecting from said inside surface of said main body at an intersection of the fitting extension region and the hook region.

2. The universal quick-change hook of claim 1, further comprising a pneumatic hose connected to said inlet of said pneumatic fitting or said outlet of said pneumatic fitting.

3. The universal quick-change hook of claim 1, wherein said outlet of said pneumatic fitting is a push-type coupler and said hook stop is arranged to protect said push-type coupler.

4. The universal quick-change hook of claim 3, wherein said hook stop extends to a location between the push-type coupler and a location of a hook-side end of a tool, employing a standard corresponding fitting, coupled to the push-type coupler.

5. The universal quick-change hook of claim 1, wherein said hook stop projects from said inside surface of said main body between −20 and 20 degrees off perpendicular from a planar surface of said fitting interface region.

6. The universal quick-change hook of claim 1, wherein the hook stop has a proximal end at the main body and a distal end distal from the main body, and wherein the hook stop includes a barb at the distal end.

7. The universal quick-change hook of claim 1, wherein said hook stop is between 0.5 and 2 inches in length.

8. The universal quick-change hook of claim 1, wherein an angle of the fitting bend is 30-80 degrees with respect to a planar surface of the fitting interface region.

9. The universal quick-change hook of claim 1, wherein said main body further includes a taper at the second end of said main body.

10. The universal quick-change hook of claim 1, wherein said hook region includes a taper bend, said taper bend defined by an angle greater than 180 degrees with respect to said inside surface of said main body.

11. The universal quick-change hook of claim 1, wherein said main body further includes a hook bend, said hook bend located at an intersection of said fitting extension region and said hook region, said hook bend defined by an angle less than 180 degrees with respect to the inside surface of said main body.

12. The universal quick-change hook of claim 1, wherein the fitting extension region includes a nail hanging hole defined by the main body and extending through the main body.

13. The universal quick-change hook of claim 12, wherein the hook region is configured to support the main body against a structure to which a nail is attached when said nail hanging hole of said main body is placed around said nail.

14. The universal quick-change hook of claim 1, wherein the main body at said hook region defines a wrench hole.

15. The universal quick-change hook of claim 14, wherein said wrench hole is a hex opening.

16. The universal quick-change hook of claim 1, further comprising an anchor assembly with an anchor pneumatic fitting, the anchor pneumatic fitting having a mating port gender opposite from a mating port gender of a pneumatic fitting to be coupled thereto, said anchor assembly configured to be coupled to a utility belt.

* * * * *

UNITED STATES PATENT AND TRADEMARK OFFICE

CERTIFICATE OF CORRECTION

PATENT NO. : 9,314,911 B2
APPLICATION NO. : 13/960275
DATED : April 19, 2016
INVENTOR(S) : Scott D. Jacobson, Gary S. Ford and Paul H. Kirk It is certified that error appears in the above-identified patent and that said Letters Patent is hereby corrected as shown below:

Claims

In Claim 1, Column 8, line 60, delete "though" and insert --through--;

In Claim 1, Column 8, line 67, insert --and-- after "direction;".

Signed and Sealed this
Second Day of August, 2016

Michelle K. Lee

Michelle K. Lee
*Director of the United States Patent and Trademark Office*